US008973665B2

(12) United States Patent
Sbordone et al.

(10) Patent No.: US 8,973,665 B2
(45) Date of Patent: Mar. 10, 2015

(54) SYSTEM AND METHOD FOR PERFORMING INTERVENTION OPERATIONS WITH A COMPLIANT GUIDE

(76) Inventors: Andrea Sbordone, Rio de Janeiro (BR); René Schuurman, Stavanger (NO); Yves Le Moign, Tanglin Park (SG); Pascal Panetta, Paris (FR); Alan J. Johnston, Noisy-le-Roi (FR); Axel Destremau, Houston, TX (US); Eric Smedstad, Rio de Janeiro (BR)

( * ) Notice: Subject to any disclaimer, the term of this patent is extended or adjusted under 35 U.S.C. 154(b) by 0 days.

(21) Appl. No.: 12/532,420

(22) PCT Filed: Mar. 18, 2008

(86) PCT No.: PCT/US2008/057303

§ 371 (c)(1),
(2), (4) Date: Feb. 1, 2010

(87) PCT Pub. No.: WO2008/118680

PCT Pub. Date: Oct. 2, 2008

(65) Prior Publication Data

US 2010/0139926 A1 Jun. 10, 2010

Related U.S. Application Data

(60) Provisional application No. 60/908,101, filed on Mar. 26, 2007.

(51) Int. Cl.
*E21B 33/076* (2006.01)
*E21B 17/01* (2006.01)

(52) U.S. Cl.
CPC ..... *E21B 17/015* (2013.01); *E21B 33/076* (2013.01)
USPC ..... 166/345; 166/349; 166/367; 166/77.1; 405/224.2

(58) Field of Classification Search
CPC ..... E21B 33/076; E21B 17/015
USPC ..... 166/345, 339, 341, 344, 346, 351, 352, 166/367, 381, 385, 386, 77.1, 77.2, 85.1, 166/85.5; 405/224.2–224.4
See application file for complete search history.

(56) References Cited

U.S. PATENT DOCUMENTS

| | | | | |
|---|---|---|---|---|
| 3,556,209 | A * | 1/1971 | Reistle et al. | 166/352 |
| 4,281,716 | A | 8/1981 | Hall | |
| 4,681,162 | A * | 7/1987 | Boyd | 166/242.5 |
| 4,730,677 | A * | 3/1988 | Pearce et al. | 166/345 |
| 4,825,953 | A | 5/1989 | Wong et al. | |
| 4,899,823 | A | 2/1990 | Cobb et al. | |

(Continued)

FOREIGN PATENT DOCUMENTS

| | | |
|---|---|---|
| GB | 1206417 | 9/1970 |
| GB | 1246839 | 9/1971 |

(Continued)

*Primary Examiner* — Matthew Buck
(74) *Attorney, Agent, or Firm* — Chamberlain Hrdlicka

(57) ABSTRACT

A technique for subsea intervention operations incorporates use of a compliant guide that extends between a surface location and a subsea installation. The technique facilitates deployment of tool strings into a subsea well. For example, a portion of the compliant guide can be used as a subsea lubricator during pressure deployment of tool strings. In some applications, a tool entry guide can be connected into the subsea installation to facilitate deployment of tool strings into the subsea well.

20 Claims, 8 Drawing Sheets

(56) References Cited

U.S. PATENT DOCUMENTS

| | | | | |
|---|---|---|---|---|
| 4,905,763 | A * | 3/1990 | Sauer et al. | 166/336 |
| 4,993,492 | A | 2/1991 | Cressey et al. | |
| 6,042,303 | A * | 3/2000 | Head | 405/195.1 |
| 6,161,619 | A * | 12/2000 | Head | 166/355 |
| 6,182,765 | B1 | 2/2001 | Kilgore | |
| 6,276,456 | B1 * | 8/2001 | Head | 166/359 |
| 6,321,846 | B1 * | 11/2001 | Rytlewski | 166/363 |
| 6,352,114 | B1 * | 3/2002 | Toalson et al. | 166/343 |
| 6,386,290 | B1 * | 5/2002 | Headworth | 166/346 |
| 6,457,529 | B2 * | 10/2002 | Calder et al. | 166/368 |
| 6,488,093 | B2 | 12/2002 | Moss | |
| 6,510,900 | B2 * | 1/2003 | Dallas | 166/384 |
| 6,520,262 | B2 * | 2/2003 | Barnett et al. | 166/367 |
| 6,648,081 | B2 * | 11/2003 | Fincher et al. | 175/25 |
| 6,691,775 | B2 * | 2/2004 | Headworth | 166/77.2 |
| 6,745,840 | B2 * | 6/2004 | Headworth | 166/346 |
| 6,834,724 | B2 * | 12/2004 | Headworth | 166/384 |
| 6,843,321 | B2 * | 1/2005 | Carlsen | 166/355 |
| 7,165,610 | B2 * | 1/2007 | Hopper | 166/84.4 |
| 7,431,092 | B2 * | 10/2008 | Haheim et al. | 166/343 |
| 7,533,732 | B2 * | 5/2009 | Boyd | 166/385 |
| 7,740,073 | B2 * | 6/2010 | Howlett | 166/311 |
| 7,757,771 | B2 * | 7/2010 | Howlett | 166/336 |
| 2002/0100591 | A1 | 8/2002 | Barnett et al. | |
| 2005/0217844 | A1 | 10/2005 | Edwards et al. | |
| 2008/0185152 | A1 * | 8/2008 | Sbordone et al. | 166/341 |
| 2008/0185153 | A1 | 8/2008 | Smedstad et al. | |

FOREIGN PATENT DOCUMENTS

| | | |
|---|---|---|
| GB | 2359106 | 8/2001 |
| GB | 2418685 | 4/2006 |
| WO | 0043632 | 7/2000 |
| WO | 2005/070565 | 8/2005 |
| WO | 2006/003362 | 1/2006 |
| WO | 2006/027553 | 3/2006 |
| WO | 2006/096069 | 9/2006 |

* cited by examiner

SYSTEM AND METHOD FOR PERFORMING INTERVENTION OPERATIONS WITH A COMPLIANT GUIDE

CROSS-REFERENCE TO RELATED APPLICATION

The present document is based on and claims priority to U.S. Provisional Application Ser. No. 60/908,101, filed Mar. 26, 2007; and International Application No. PCT/US2008/057303, filed Mar. 18, 2008.

BACKGROUND

The retrieval of desired fluids, such as hydrocarbon based fluids, is pursued in subsea environments. Production and transfer of fluids from subsea wells relies on subsea installations, subsea flow lines and other equipment. Additionally, preparation and servicing of the subsea well relies on the ability to conduct subsea intervention work. A big challenge in subsea intervention work is controlling pressure so that pressurized borehole fluids in the subsea well are contained within the borehole during intervention operations.

Subsea intervention work involves numerous challenges not normally faced when working on land wells or offshore platforms. In most cases, intervention in subsea wells is performed from a floating platform or ship by extending the borehole to a surface location by a tensioned riser. This approach allows pressurized borehole fluids to move upwardly to the surface through the riser which can span hundreds or thousands of feet of sea water. The cost of such platforms is high, however, and the availability of vessels capable of adequately performing this type of intervention work is limited.

In shallow waters, subsea intervention work can be performed with a specially equipped vessel having subsea lubricators, subsea pressure control equipment, and wave motion compensating systems. In most cases, guide wires extending from a wellhead all the way to the vessel combined with the aid of professional divers is required. Additionally, this approach requires that equipment is conveyed and guided from the vessel to the subsea installation through open waters. Once the subsea lubricator is connected to the subsea installation and the tools are inside, the conveyance cable remains exposed to open waters. Additionally, pressure control must be exercised at the seabed. Because existing non-rig intervention capability is limited to shallow water wireline and slickline operations, most intervention on subsea wells is currently performed with expensive and scarce heavy drilling units.

SUMMARY

In general, the present invention provides a technique for subsea intervention operations which utilizes a compliant guide, e.g. a spoolable compliant guide, which extends between a surface location and a subsea installation. The overall system is designed to facilitate deployment of tool strings into a subsea well. For example, at least a portion of the compliant guide can be used as a subsea lubricator during pressure deployment of tool strings to reduce the height of the subsea lubricator or to completely eliminate the need for a separate subsea lubricator. In alternate or other applications, a tool entry guide can be connected into the subsea installation to facilitate deployment of tool strings into the subsea well.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
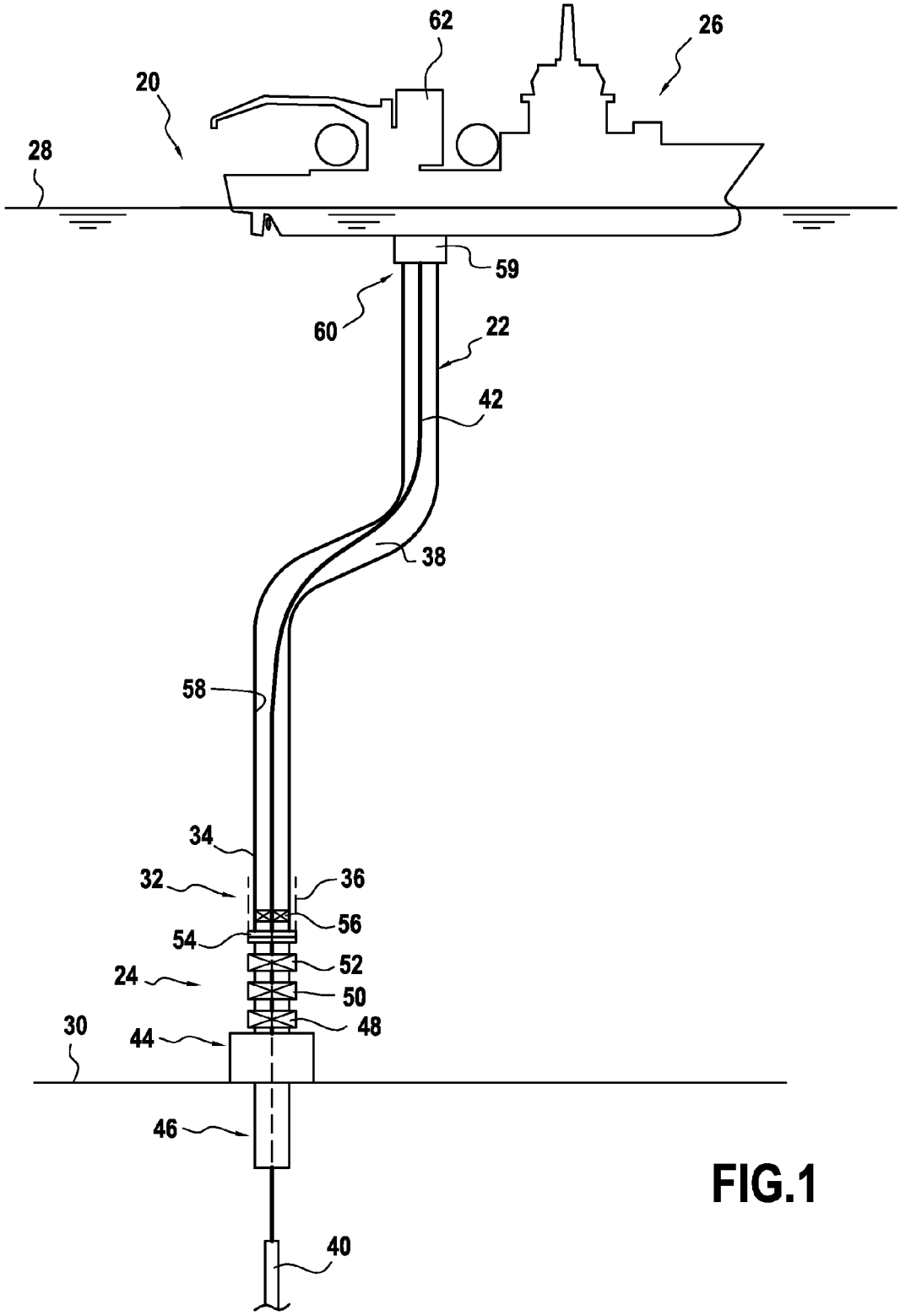
FIG. 1 is a schematic front elevation view of a subsea intervention system, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a technique for intervening in subsea installations, such as subsea wells. The technique also provides unique ways of utilizing a compliant guide, such as a spoolable compliant guide, to facilitate intervention operations with a variety of tool strings. For example, the compliant guide can be used as a subsea lubricator for the pressure deployment of tool strings during intervention operations. The compliant guide also can be used in conjunction with a tool entry guide that enables insertion of tool strings from a position external to the compliant guide.

In using the compliant guide as a subsea lubricator, the compliant guide is coupled to a subsea installation, and a lower portion of the compliant guide is generally used as the subsea lubricator. In some applications, the lower portion of the compliant guide can serve as the entire subsea lubricator. In other applications, the lower portion of the compliant guide can serve as a subsea lubricator in combination with a separate or supplemental subsea lubricator. The compliant guide can be utilized as a subsea lubricator when deploying a variety of tool strings, e.g. tool strings having relatively small diameters. In other applications, such as intervention operations deploying larger diameter tool strings, the tool entry guide can be used to insert the tool string from a location external to the compliant guide.

Use of the compliant guide enables pressure deployment of tool strings in an efficient and advantageous manner. As referenced above, utilizing the compliant guide as a subsea lubricator during the pressure deployment of tool strings reduces the required height of a conventional subsea lubricator or completely eliminates the need for a conventional subsea lubricator. Alternatively, certain tool strings, e.g. large diameter tool strings with relatively short tools, can be deployed through the tool entry guide and a short subsea lubricator.

Additionally, many other aspects of subsea intervention equipment and operations can be improved by utilizing the lower portion of the compliant guide as the subsea lubricator. For example, bending forces on the subsea intervention installation are reduced due to its reduced height. Also, use of the compliant guide as a subsea lubricator improves the efficiency of the pressure deployment of tool strings during subsea intervention operations. Furthermore, the risk of environmental damage during the deployment sequence is reduced. The elimination of subsea tool handling equipment and elimination of the conventional subsea lubricator also simplifies the process of pressure deployment of tool strings. There also is greater flexibility in the variety of tool string types that can be deployed. For example, the tool strings are not limited to tools that can be stored inside the subsea equipment, and the tool string length is not limited by the length of conventional subsea lubricators.

Referring generally to the Figures, examples of the compliant guide systems and techniques discussed above are illustrated. In FIG. 1, an intervention system 20 is illustrated according to an embodiment of the present invention. In this embodiment, system 20 comprises a guide 22, such as a compliant guide which may be in the form of a spoolable compliant guide. In other applications, guide 22 may comprise a riser, such as a flexible riser. In the embodiment illustrated, compliant guide 22 is coupled between a subsea installation 24 and a surface vessel 26, such as an intervention vessel located at a surface 28 of the sea. Subsea installation 24 may be located on or at a seabed floor 30. The compliant guide 22 may be pressurized to control the high pressure borehole fluids.

Compliant guide 22 comprises a lower portion 32 that may serve as a compliant guide subsea lubricator 34. In other applications, additional portions of compliant guide 22 or the entire compliant guide 22 can be utilized as the subsea lubricator 34. The compliant guide subsea lubricator 34 can be adjusted to accommodate tool strings of a variety of lengths and configurations. Depending on the intervention application, compliant guide subsea lubricator 34 can be used as the sole lubricator or in combination with a shortened conventional subsea lubricator 36, as represented by dashed lines in FIG. 1. It also should be noted that in other applications, the subsea lubricator 34 can be formed as part of other types of guides, such as flexible risers, hybrid risers, or tensioned risers.

In the embodiment illustrated, compliant guide 22 is flexible and may be arranged in a variety of curvilinear shapes extending between a surface location, e.g. intervention vessel 26, and subsea installation 24. This flexibility allows the compliant guide 22 to be arranged in a variety of configurations, as desired, to facilitate deployment or retraction of tool strings. By way of example, compliant guide 22 may be constructed as a tubular member formed from a variety of materials that are sufficiently flexible, including metal materials of appropriate cross-section and composite materials.

In this embodiment, compliant guide 22 is filled with a buffer fluid 38, such as seawater, introduced into the interior of compliant guide 22. In some applications, other buffer fluids 38 can be used, e.g. environmentally friendly greases for friction reduction or for pressure sealing; fluids designed for hydrate prevention; weighted mud; and other appropriate buffer fluids. The level and pressure of buffer fluid 38 can be controlled from the surface to both maintain control over borehole fluids and to facilitate movement of an intervention tool string 40.

Once compliant guide 22 is coupled between subsea installation 24 and intervention vessel 26, the intervention tool string 40 can be deployed for a desired intervention operation. In one embodiment, intervention tool string 40 is conveyed from intervention vessel 26 down through compliant guide 22 to compliant guide subsea lubricator 34. The tool string is then moved through subsea installation 24 via a conveyance 42, as described in greater detail below. The compliant guide 22 also provides the path along which the intervention tool string 40 can be retrieved to the surface. For example, an intervention tool string 40 can be delivered to the subsea installation and upon completion of a specific intervention operation, the tool string 40 can be retrieved to the surface and interchanged with another intervention tool string. This process is readily repeated as many times as necessary to complete the entire intervention operation.

Conveyance 42 may be a flexible, cable-type conveyance, such as a wireline or slickline However conveyance 42 also may comprise stiffer mechanisms including coiled tubing and coiled rod. Compliant guide 22 can be arranged to facilitate passage of the intervention tool string 40 without requiring a pushing force, at least in some applications. In other words, the curvilinear configuration of compliant guide 22 is readily adjustable via, for example, locating or moving intervention vessel 26 so as to avoid bends or deviated sections that could interfere with the passage of intervention tool string 40. The desired orientation of the compliant guide also may be changed from one intervention operation to another or during a given intervention operation depending on parameters, such as current, subsea obstacles, surface obstacles and other environmental factors.

Although subsea intervention operations can be performed on a variety of subsea installations 24, one example is illustrated in FIG. 1. In this example, the subsea installation 24 comprises a subsea wellhead 44, that may comprise a Christmas tree, coupled to a subsea well 46. Subsea installation 24 also comprises a subsea lubricating seal 48 that may be deployed directly above subsea wellhead 44. Lubricating seal 48 can be used to close the borehole of subsea well 46 during certain intervention procedures. A blowout preventer 50 may be positioned above lubricating seal 48 and may comprise one or more cut-and-seal rams able to cut through the interior of the subsea installation and seal off the subsea installation during an emergency disconnect. The subsea installation 24 also may comprise additional blowout preventers as well as a subsea stripper assembly 52 positioned above blowout preventer 50. Additionally, a connector 54 is positioned to enable coupling of compliant guide 22 with subsea installation 24. The subsea installation 24 also may comprise other devices, such as emergency disconnect devices that allow an operator to perform an emergency disconnection.

Generally, subsea lubricating seal 48 acts as a pressure barrier between subsea wellhead 44 and compliant guide 22. The subsea stripper assembly 52 cooperates to maintain the pressure seal between the wellbore and compliant guide 22 while conveyance 42 is moved in and out of subsea well 46. The stripper assembly 52 may comprise multiple stripper elements to ensure the integrity of the assembly. Furthermore, the one or more blowout preventers 50 may comprise rams, e.g. hydraulically operated rams, able to secure the well with or without conveyance 42 extending through subsea installation 24.

Additionally, intervention system 20 comprises a subsea fluid separation seal 56 positioned generally at the bottom of compliant guide 22 to help block incursion of well fluids into an interior 58 of the compliant guide 22. For example, subsea fluid separation seal 56 can be positioned within the lower end of compliant guide 22, or it can be positioned at other locations by the lower end of compliant guide 22, e.g. proximate the one or more blowout preventers 50 or stripper assembly 52. It should be noted that the interior 58 is filled with buffer fluid 38 which can be used to regulate the pressure differential acting on subsea fluid separation seal 56. Fluid separation seal 56 may comprise, for example, a fixed dynamic seal which is permanently placed in the lower part of compliant guide 22. In this embodiment, the fluid separation seal 56 opens and closes around the conveyance 42 to let the tool string pass during, for example, deployment. Alternatively, subsea fluid separation seal 56 can be mounted as a retrievable seal which can be conveyed up and down inside the compliant guide 22 together with conveyance 42. In this latter embodiment, the fluid separation seal is locked in place once it reaches the appropriate locking location within or by the lower end of compliant guide 22. Furthermore, the pressure within compliant guide 22 can be adjusted to create a desired pressure differential over subsea fluid separation seal 56 to facilitate various intervention operations. Fluid separation seal 56 separates buffer fluid 38 from borehole fluids by sealing against conveyance 42, e.g. against coiled tubing, coiled rod, wireline, slickline, or other conveyances, while allowing movement of the conveyance 42 into and out of subsea well 46.

The compliant guide 22 also can be used in cooperation with a variety of additional or alternate components that facilitate intervention operations. Some of these components facilitate the conveyance and retrieval of intervention tool string 40 from, for example, deep water locations with a variety of conveyances, including cable-type mechanisms. Other components improve the longevity of the system or aid in carrying out emergency procedures.

For example, an emergency disconnect 59 can be provided at surface vessel 26 proximate an upper end 60 of compliant guide 22. Emergency disconnect 59 has a cutting and sealing capacity to selectively seal off fluid flow. Alternate or additional emergency disconnects can be placed at other locations, such as at or proximate subsea installation 24. Additionally, a surface stripper assembly 62 can be mounted on surface vessel 26. Surface stripper assembly 62 may be utilized for well pressure control when subsea lubricating seal 48 is open and communication with subsea well 46 is established for certain tool string deployment sequences. Depending on the operation, a wide variety of other components can be incorporated into the system, including side entry subs, coiled tubing/coiled rod injection heads, connection and disconnection devices for compliant guide 22, umbilicals and remotely operated vehicles, controls and other components utilized in various intervention operations.

Figure 2:
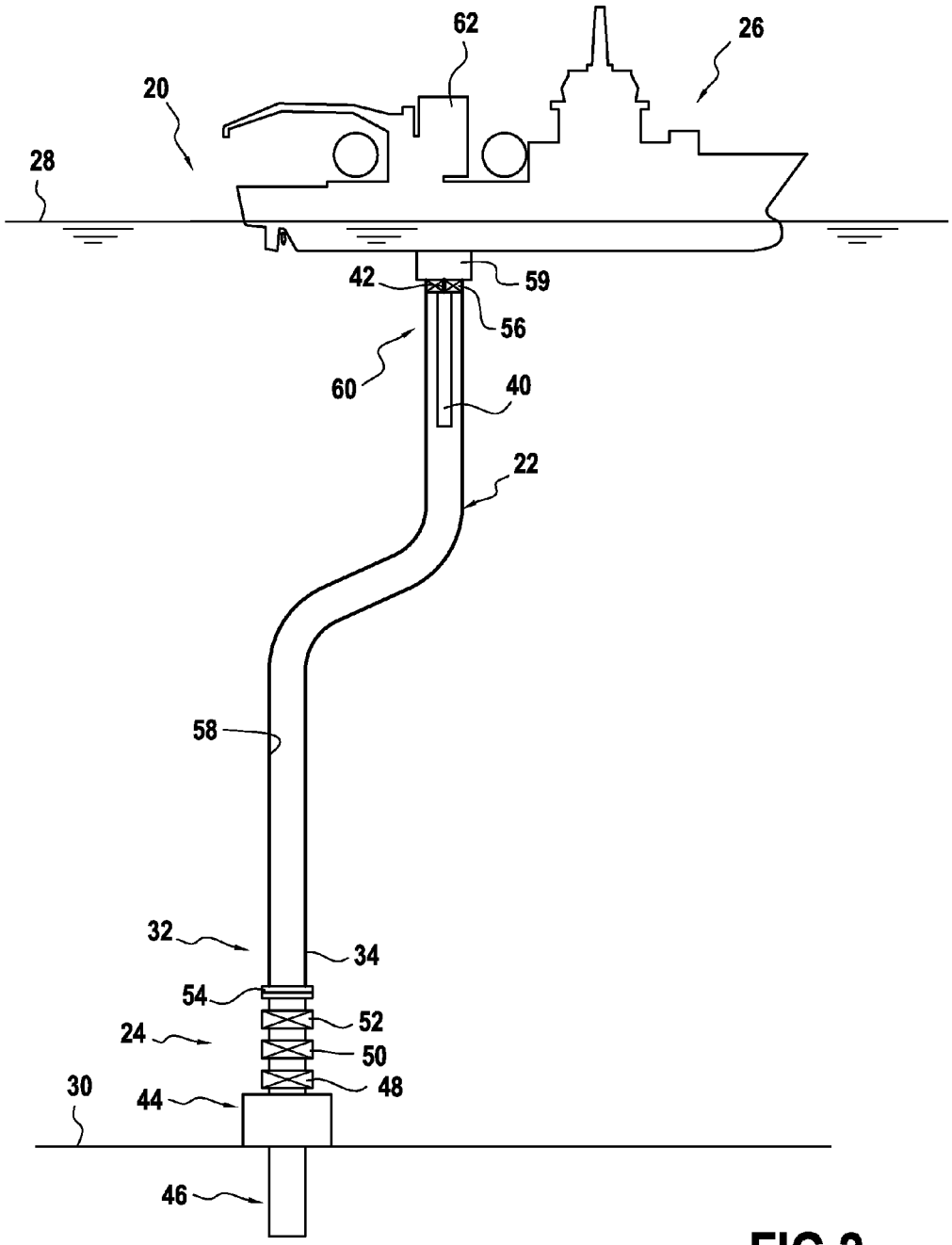
FIG. 2 is a schematic front elevation view similar to that of FIG. 1 but showing an intervention tool string being deployed into a compliant guide, according to an embodiment of the present invention.

In conducting a pressure deployment sequence for a well intervention operation, subsea well 46 is initially closed, and the pressure in compliant guide 22 is released to inflow test, i.e. negative pressure test, subsea lubricating seal 48. The inflow test ensures the integrity of subsea lubricating seal 48. Upon successful completion of the inflow test, tool string 40 can be deployed into the upper portion of compliant guide 22, as best illustrated in FIG. 2. In this particular embodiment, the subsea fluid separation seal 56 is deployed with tool string 40, as illustrated.

Figure 3:
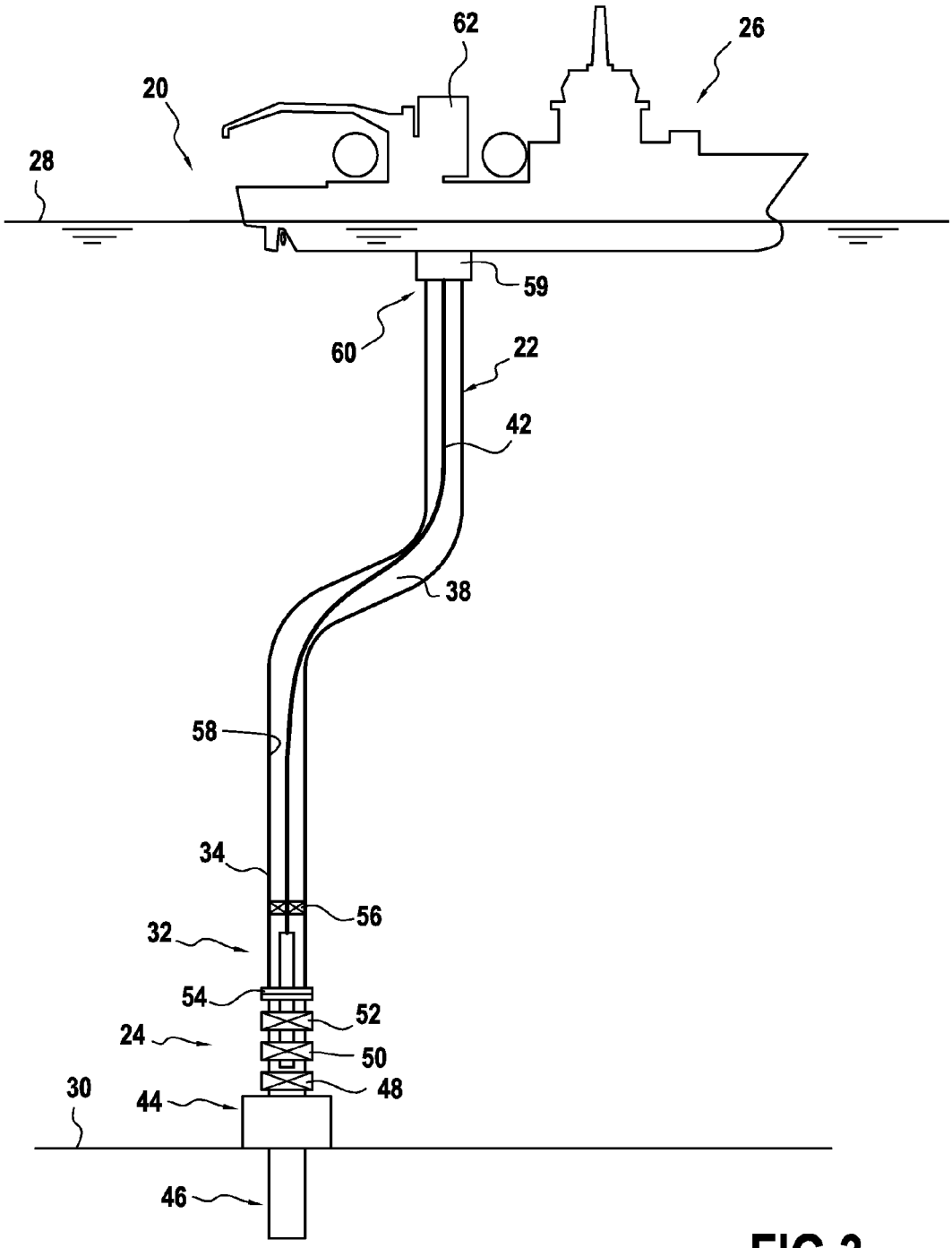
FIG. 3 is a schematic front elevation view similar to that of FIG. 1 but showing the intervention tool string deployed proximate a subsea lubricating seal, according to an embodiment of the present invention.

The tool string 40 and a subsea fluid separation seal 56 are run down through compliant guide 22 to compliant guide subsea lubricator 34 and into proximity with subsea lubricating seal 48, as illustrated in FIG. 3. Because the lower portion of compliant guide 22 functions as the subsea lubricator in whole or in part, tool strings of a wide variety of lengths and configurations can be deployed. Once tool string 40 is properly positioned proximate subsea lubricating seal 48, the surface stripper assembly 62 is closed and the compliant guide system is pressure tested for integrity. Following successful completion of a positive pressure test, the pressure within compliant guide 22 is adjusted to a pressure generally matching the wellhead pressure at wellhead 44. The pressure within compliant guide 22 can be adjusted with standard pressure control equipment, for example, mounted on surface vessel 26. After adjusting the pressure within compliant guide 22, subsea fluid separation seal 56 is locked in place generally at a lower end of compliant guide 22, either within or below compliant guide 22. The subsea fluid separation seal 56 separates wellbore fluids from buffer fluid 38 within compliant guide 22.

Figure 4:
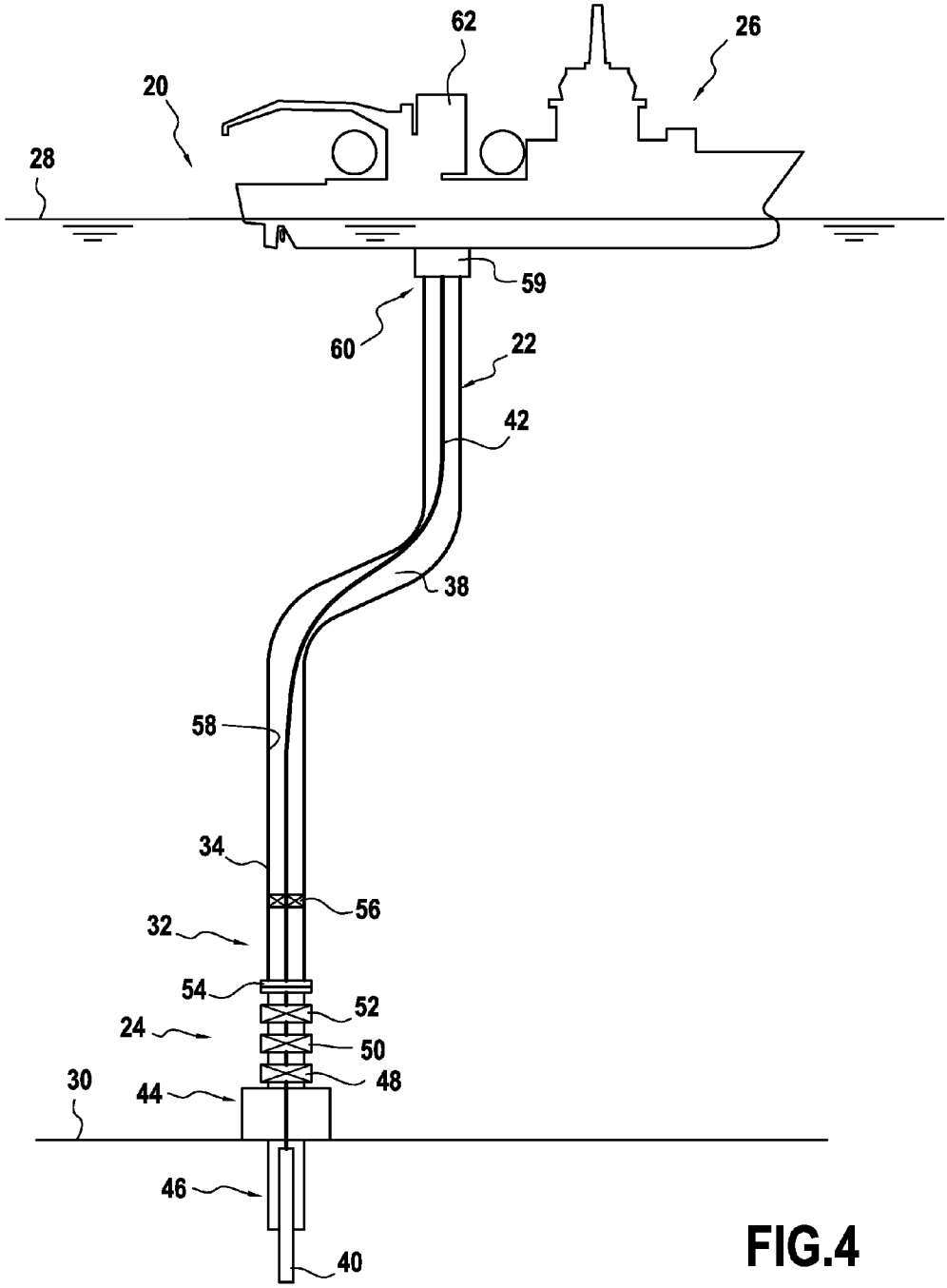
FIG. 4 is a schematic front elevation view similar to that of FIG. 1 but showing the intervention tool string being deployed into a subsea wellbore, according to an embodiment of the present invention.

Once subsea fluid separation seal 56 is activated, subsea lubricating seal 48 is opened, and tool string 40 is run into subsea well 46 for performance of the planned intervention services, as illustrated best in FIG. 4. When the tool string 40 is moved past subsea wellhead 44, the subsea stripper assembly 52 can be activated and used as the primary seal for controlling the wellbore pressure. After completion of the intervention operation, the tool string 40 is retrieved up through compliant guide 22 by simply reversing the deployment sequence.

In this embodiment, use of compliant guide 22 as a subsea lubricator 34 in conjunction with the deployment sequence described reduces the necessary height of or eliminates the need for any standard subsea lubricator. This, in turn, reduces the height of subsea installation 24 which reduces bending forces acting on the subsea installation. Furthermore, the use of compliant guide 22 between surface vessel 26 and the subsea installation eliminates the need for wave motion compensation. The compliant guide also reduces the risk of wellbore fluid leakage to the environment, because any leaks are contained within compliant guide 22 and can be circulated out to the surface vessel 26. Additionally, medium standard handling equipment can be used for installation of tool string 40 to conveyance 42 which simplifies the deployment process compared to conventional subsea deployment systems. As mentioned above, some applications can be designed to utilize the subsea lubricator 34 as part of other guide components, including flexible risers, hybrid risers, and tensioned risers.

Figure 5:
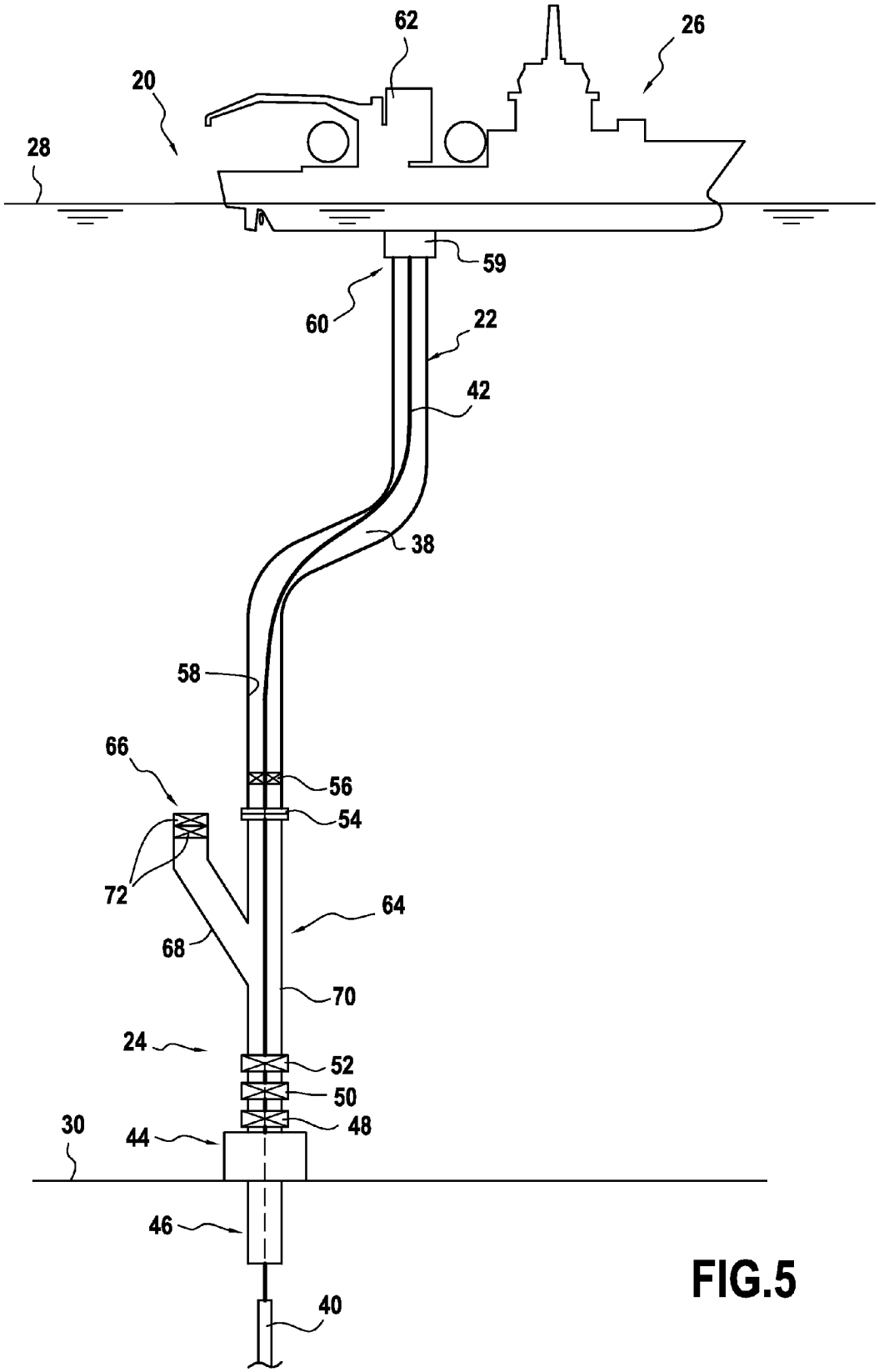
FIG. 5 is a schematic front elevation view of an embodiment of the subsea intervention system, according to an alternate embodiment of the present invention.

Another embodiment of intervention system 20 is illustrated in FIG. 5. In this embodiment, a tool entry guide 64 is coupled to subsea installation 24 below compliant guide 22. Tool entry guide 64 can be used to accommodate deployment of a variety of tool strings, including larger diameter tool strings that can be more difficult to deploy through compliant guide 22. The tool entry guide 64 comprises a tool entry guide inlet 66 which is located externally of compliant guide 22. In the embodiment illustrated, an angled tool guide section 68 forms a passageway between inlet 66 and a primary tool guide section 70 generally aligned with the lower portion of compliant guide 22 and subsea well 46. Tool entry guide 64 further comprises one or more isolation valves 72, such as the pair of isolation valves 72 positioned at guide inlet 66. By using tool entry guide 64, it is not necessary to disconnect compliant guide 22 during deployment of tool string 40 which reduces the pollution risk. Additionally, the ability to maintain connection of the compliant guide decreases the time required for a deployment sequence.

Figure 6:
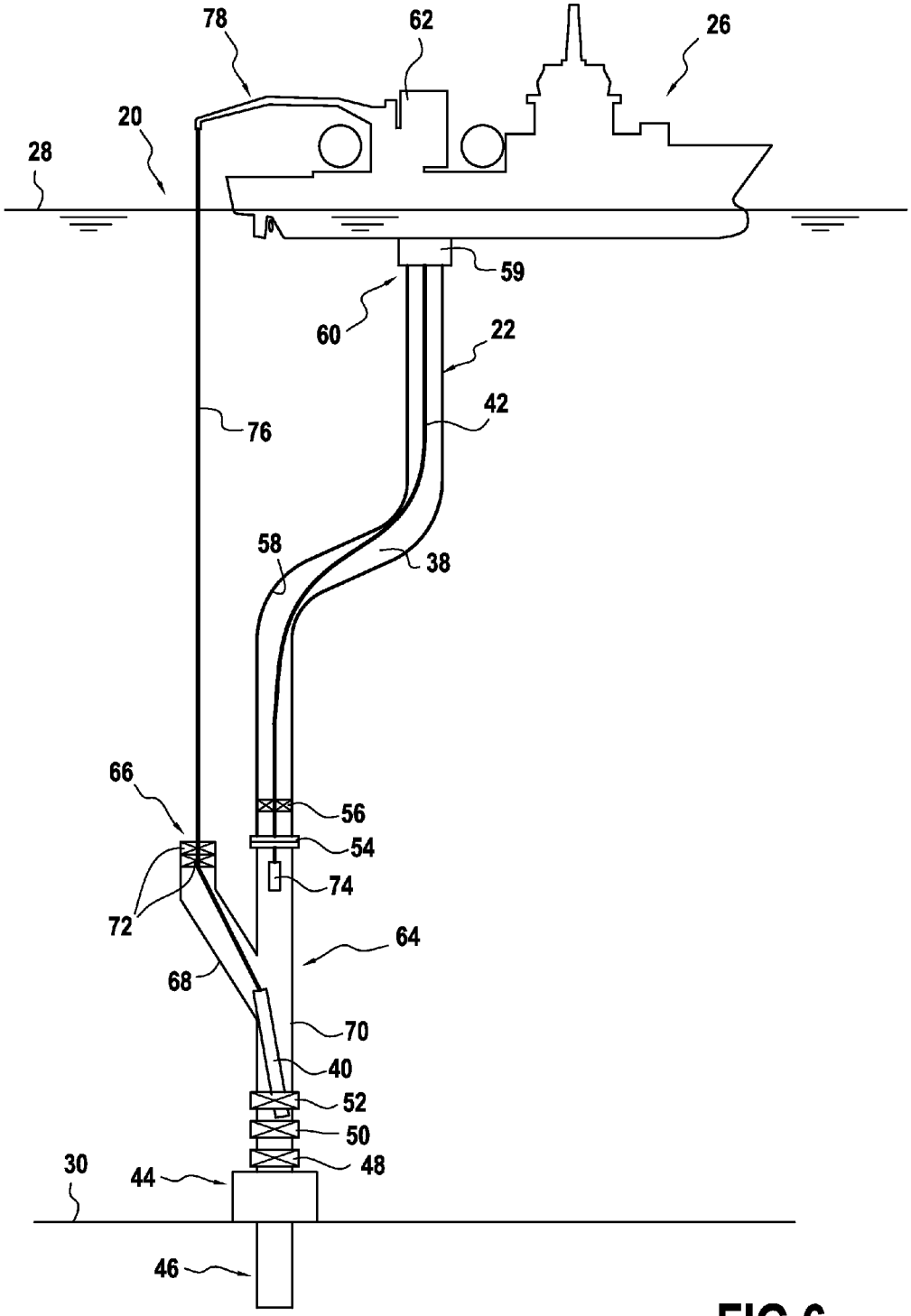
FIG. 6 is a schematic front elevation view similar to that of FIG. 5 but showing the intervention tool string being deployed into a tool entry guide, according to an embodiment of the present invention.

In conducting a pressure deployment sequence for a well intervention operation, compliant guide 22 is initially run and connected to tool entry guide 64 via connector 54. Conveyance 42 along with a tool string connector 74 and subsea fluid separation seal 56 are run through compliant guide 22 to a location generally proximate the top of tool entry guide 64. Tool string 40 is lowered through the sea via a running line 76, such as a wireline or a slickline, or a running line dispensed from a crane 78 mounted on surface vessel 26. The tool string 40 is run externally of compliant guide 22 and into tool entry guide inlet 66. From inlet 66, the tool string 40 moves downward along angled tool guide section 68 and generally into primary tool guide section 70, as illustrated best in FIG. 6.

Figure 7:
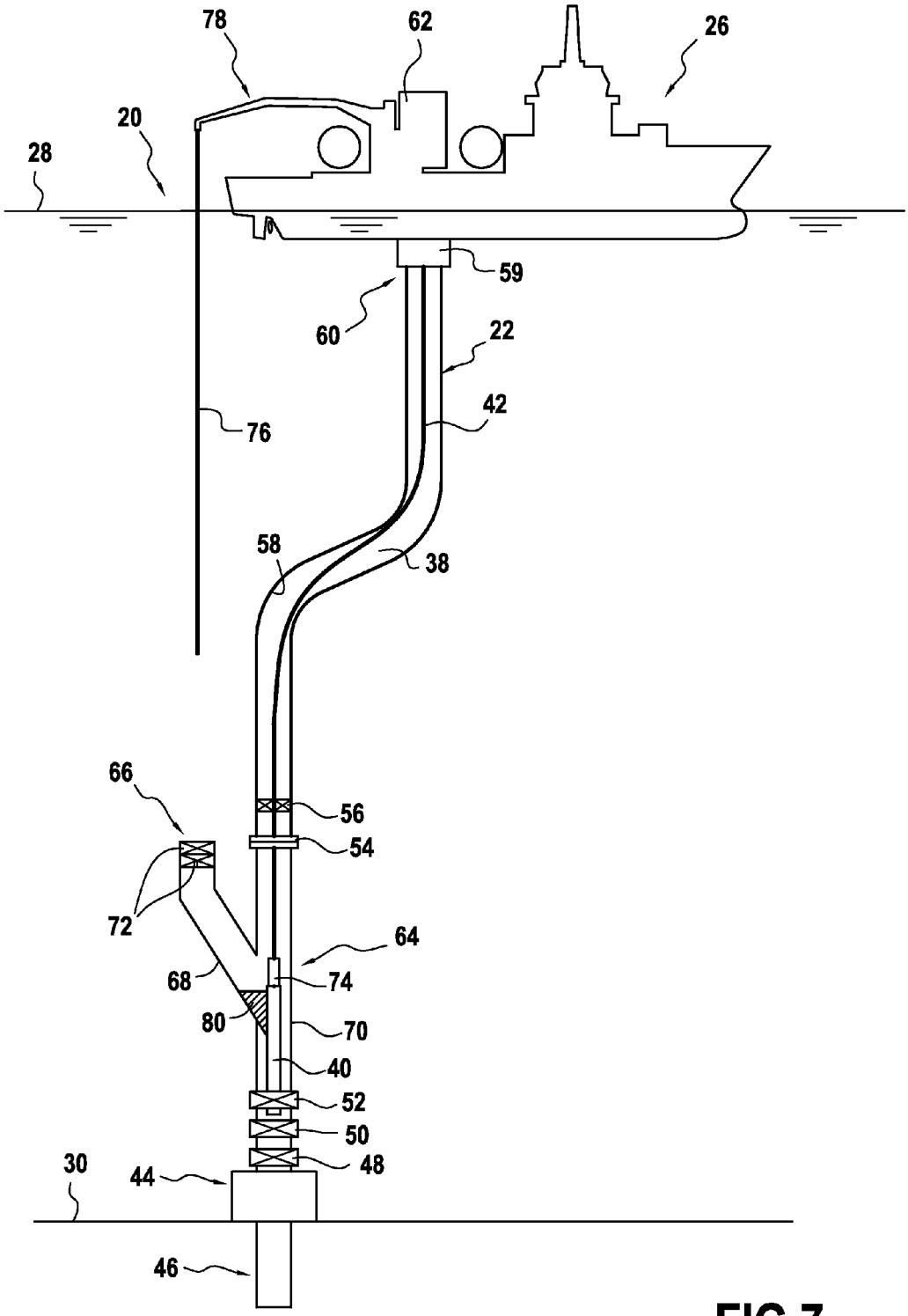
FIG. 7 is a schematic front elevation view similar to that of FIG. 5 but showing the intervention tool string being locked in place for engagement with a conveyance extending through the compliant guide, according to an embodiment of the present invention.

Once tool string 40 is positioned in tool entry guide 64, the tool string is locked in place by a tool lock 80, as illustrated in FIG. 7. Running line 76 is then disconnected and retrieved. The isolation valves 72 are then closed to seal off tool entry guide inlet 66, and conveyance 42 is lowered until tool string connector 74 engages tool string 40.

Figure 8:
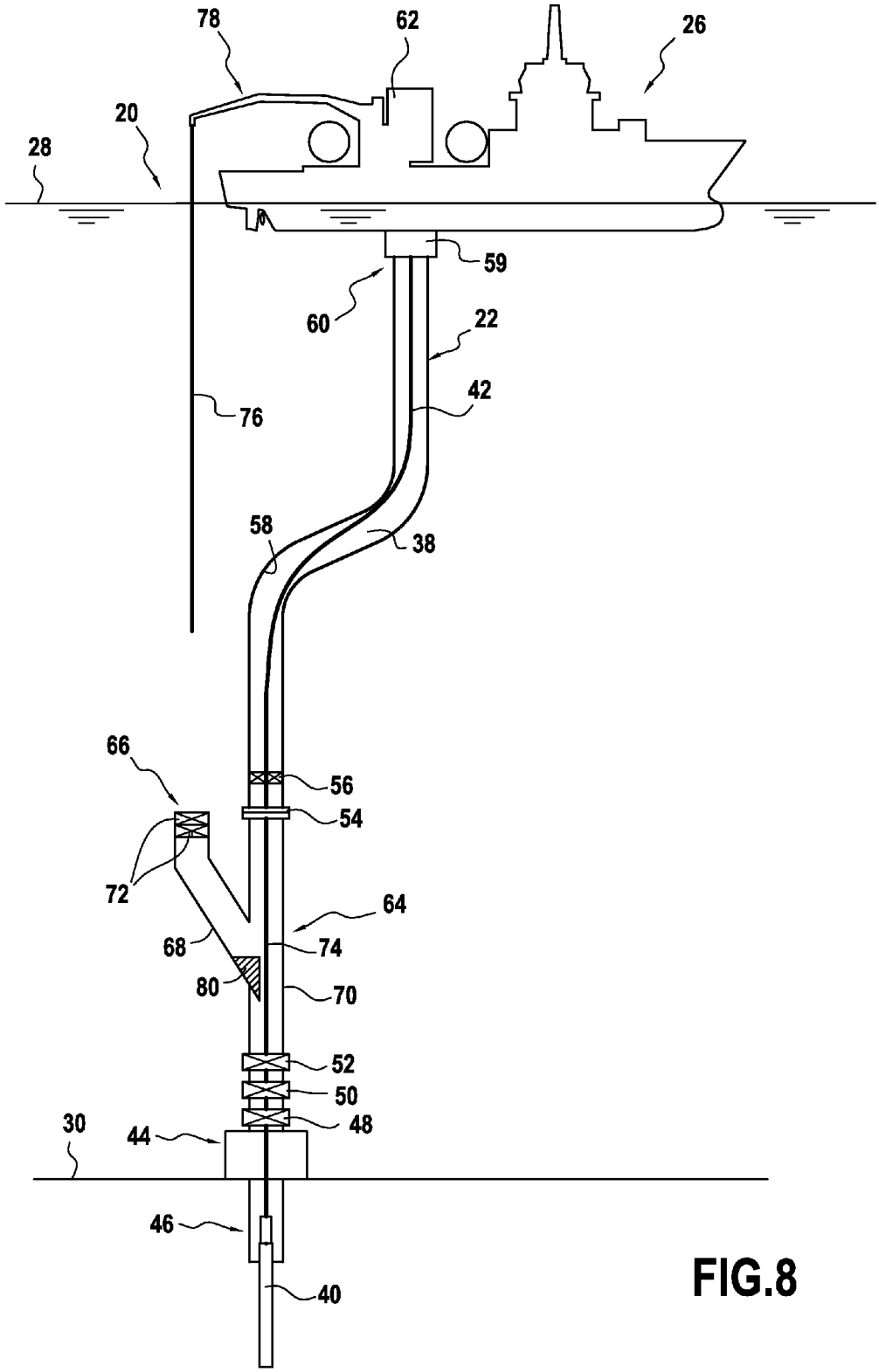
FIG. 8 is a schematic front elevation view similar to that of FIG. 5 but showing the intervention tool string being deployed into the subsea wellbore, according to an embodiment of the present invention.

The compliant guide 22 is then pressure tested, and tool lock 80 is released following successful pressure testing. At this point, pressure within compliant guide 22 is adjusted until generally balanced with the wellbore pressure. After the desired pressure balance is achieved, the separation seal 56 is activated. When the separation seal 56 is activated, the subsea lubricating seal 48 can be opened, and tool string 40 along with conveyance 42 can be run into subsea well 46, as illustrated in FIG. 8. Upon completion of the desired intervention operation, tool string 40 can be retrieved simply by reversing the above described deployment sequence.

Intervention system 20 facilitates deployment of many types of tool strings in a dependable and efficient manner. Use of a lower section of the compliant guide or of a flexible riser as part of or as the entire subsea lubricator greatly improves the intervention procedures with a variety of tool strings. Furthermore, use of the tool entry guide provides further adaptability and other improvements to the intervention operation by readily accommodating other types of tool strings, including larger diameter tool strings.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for use with a subsea well, comprising:

a guide disposed between a surface location and a subsea installation, wherein at least a lower portion of the guide serves as a subsea lubricator;

a blowout preventer disposed above the subsea well; and a subsea fluid separation seal conveyable through and disposed within the guide and able to accommodate movement of a conveyance therethrough, wherein the seal is disposed above the blowout preventer.

2. The system as recited in claim 1, wherein the guide is a compliant guide.

3. The system as recited in claim 1, wherein the guide is a spoolable compliant guide.

4. The system as recited in claim 2, further comprising the subsea installation, wherein the subsea installation comprises a subsea wellhead and a pressure barrier between the subsea wellhead and the compliant guide.

5. The system as recited in claim 1, further comprising the subsea installation, wherein the subsea installation comprises a subsea wellhead and a pressure barrier between the subsea wellhead and the guide.

6. The system as recited in claim 2, further comprising a buffer fluid within the compliant guide.

7. A method of intervening in a subsea well, comprising:

coupling a guide between a surface location and a subsea installation; and utilizing at least a lower portion of the guide as a subsea lubricator during pressure deployment of a tool string, comprising:

disposing a subsea fluid separation seal within the guide and above a blowout preventer disposed above the subsea well;

conveying the subsea fluid separation seal through the guide; and conveying the tool string through the subsea fluid separation seal.

8. The method as recited in claim 7, wherein coupling comprises coupling a compliant guide between the surface location and the subsea installation.

9. The method as recited in claim 7, wherein coupling comprises coupling a spoolable compliant guide between the surface location and the subsea installation.

10. The method as recited in claim 8, further comprising:

positioning the subsea fluid separation seal proximate a lower end of the compliant guide; and subsequently moving the tool string down to the subsea fluid separation seal.

11. The method as recited in claim 10, further comprising subsequently adjusting the pressure in the compliant guide to control the wellhead pressure.

12. The method as recited in claim 7, further comprising:

opening the subsea fluid separation seal; and running the tool string into the subsea well.

13. The method as recited in claim 10, wherein utilizing comprises utilizing the lower portion of the compliant guide as the subsea lubricator in combination with another subsea lubricator.

14. A method of intervening in a subsea well, comprising:

coupling a guide between a surface location and a subsea installation;

connecting a tool entry guide to the subsea installation such that an inlet of a tool entry guide is positioned externally of the guide;

running a tool string to the tool entry guide externally of the guide; and holding the tool string with a tool lock to facilitate connection of the tool string with a conveyance deployed through the guide.

15. The method as recited in claim 14, wherein coupling comprises coupling a spoolable compliant guide between the surface location and the subsea installation.

16. The method as recited in claim 14, further comprising deploying a fluid separation seal to a position proximate a lower end of the guide.

17. The method as recited in claim 14, further comprising:

sealing the inlet of the tool entry guide; and deploying the tool string into the subsea well.

18. A method of intervening in a subsea well, comprising:

coupling a guide between a surface location and a subsea installation;

utilizing at least a lower portion of the guide as a subsea lubricator having a first configuration;

lowering the guide and the subsea lubricator toward the subsea installation;

conducting a subsea intervention with a tool having a first configuration;

retrieving the tool and the subsea lubricator toward the subsea installation;

utilizing at least a lower portion of the guide as a second subsea lubricator having a second configuration;

lowering the guide and the second subsea lubricator toward the subsea installation; and conducting a subsea intervention with a second tool having a second configuration.

19. The method as recited in claim 18, wherein the tool having a first configuration is storable inside the subsea installation and the tool having a second configuration is too large for storage inside the subsea installation.

20. A method of intervening in a subsea well, comprising:

coupling a guide between a surface location and a subsea installation;

disposing a blowout preventer above the subsea well:

disposing a subsea fluid separation seal within the guide and above the blowout preventer;

utilizing at least a lower portion of the guide as a subsea lubricator; and conducting a subsea intervention with a tool having a length greater than that of the subsea installation.

* * * * *